US006425435B1

(12) United States Patent
Macheske et al.

(10) Patent No.: US 6,425,435 B1
(45) Date of Patent: Jul. 30, 2002

(54) MODULE CASTING SYSTEMS WITH SHARED CONTROLS

(75) Inventors: Robert L. Macheske, Tawas City, MI (US); Kenneth D. McKibben, Defiance, OH (US); Daniel D. Minor, Cadillac; Rick A. Van Horn, Hale, both of MI (US)

(73) Assignee: Hayes Lemmerz Equipment & Engineering, Inc., Au Gres, MI (US)

( * ) Notice: Subject to any disclaimer, the term of this patent is extended or adjusted under 35 U.S.C. 154(b) by 0 days.

(21) Appl. No.: 09/362,150

(22) Filed: Jul. 28, 1999

(51) Int. Cl.[7] ..... B22D 5/02; B22D 33/02

(52) U.S. Cl. ..... 164/326; 164/130; 164/322; 164/325

(58) Field of Search ..... 164/15.1, 154.2, 164/322–328, 18, 306, 129, 130, 167, 168

(56) References Cited

U.S. PATENT DOCUMENTS 4,224,977 A 9/1980 Cygler et al.
4,589,467 A 5/1986 Hunter
4,840,218 A 6/1989 Hunter
4,890,664 A 1/1990 Hunter
5,598,882 A * 2/1997 Merrill ..... 164/306
5,601,135 A 2/1997 Merrill
5,671,799 A 9/1997 Merrill
5,697,424 A 12/1997 Ferdinandsen et al.
5,701,945 A * 12/1997 McKibben et al. ..... 164/130

* cited by examiner

*Primary Examiner*—M. Alexandra Elve
*Assistant Examiner*—Kevin P. Kerns
(74) *Attorney, Agent, or Firm*—Varnum, Riddering, Schmidt & Howlett LLP

(57) ABSTRACT

A modular casting system includes a plurality of casting modules and, is provided with on-board systems such as a lubrication system, cooling system, etc., which operate independently from similar systems on other modules of the system. Each of the casting modules is connected by quick disconnect connections to a centrally disposed source of fluid pressure and electrical power and a control unit for controlling each of the modules independently. Each of the modules is readily removable from the system and replaced with a new module of a different type or with a different mold. Each of the modules is preferably provided with a filter removal unit which is operative to raise of the filter during the cooling operation and facilitates removal of the filter upon completion of the pouring operation. The casting modules are provided with a tilting launder tray which facilitates laundering of the mold after a casting operation. The upper platen of a casting module is provided with a swinging cope which is movable between a horizontal position and a vertical position to facilitate cleaning of the cope. The lower platen is preferably provided with a pneumatic hydraulic cylinder arrangement including a mechanism for raising the casting from the drag.

11 Claims, 11 Drawing Sheets

MODULE CASTING SYSTEMS WITH SHARED CONTROLS

BACKGROUND OF THE INVENTION

1. Field of the Invention

The invention relates to automated casting systems and more particularly to a casting system employing a plurality of casting units disposed on a rotating table or the like.

2. Background Art

A casting system, besides a casting mold, typically includes a mechanism for opening and closing the mold and a variety of electrical, pneumatic, and/or hydraulic systems which serve to perform a variety of controlling functions in the overall molding process. Furthermore, lubrication systems and cooling systems may be required. A problem with prior art casting systems is the difficulty encountered in substituting a different configuration mold in an existing system. Since molds of various different shapes and configurations may be required from time-to-time and connections for the various systems to control the molding apparatus may vary substantially between molds, the changeover from one set of molds to another results in significant and expensive downtime for the casting system. Such changeover may require re-routing of electrical cabling and connections for pneumatic and hydraulic as well as cooling systems. Furthermore, in typical prior art arrangements, a plurality of molds and the apparatus for opening and closing the molds are disposed on a rotating table or the like. In case of a breakdown or routine maintenance of the opening and closing mechanism for a particular mold or of the mold itself, the entire casting system must be shut down. Such a shut-down tends to be time-consuming since the system typically has to be cooled down for maintenance work and must be brought back to working temperature before operations can be resumed. A particular disadvantage of prior art systems is the costly downtime of the entire system for maintenance, repair or changeover of molds.

Routine molding operations typically require that a filter used in the casting operation be removed and replaced before a next pouring of the molten metal or the like. This is commonly done manually. In order to avoid introducing the necessary delays in the casting operation, the filter is typically removed as soon as possible after the previous pouring operation, often while it is still very hot. The filter removal can be both difficult and time consuming. A further difficulty in the routine operation of a casting system is that the mold is preferably laundered after a casting operation and coated with a specialized coating prior to the next pouring. The functions of laundering and coating are typically performed manually and tend to be difficult and time consuming, adding to the cost of the casting operation.

A further difficulty in many casting operations is the removal of a casting from the mold, particularly from the drag of the mold, while the casting is hot.

SUMMARY OF THE INVENTION

These and other problems of the prior art are overcome in accordance with this invention in a modularized system comprising a plurality of casting modules, each of which may be removed from a casting system, such as a rotating table casting system, without affecting the operation of other modules. Each module is provided with on-board systems such as a lubrication system, a cooling system, etc., which operate independently from similar systems on other modules. Each module is provided with quick-disconnect connectors for connection to a main source of electrical power, hydraulic pressure, etc. The modules are preferably interchangeable and a variety of different modules may be installed in one main system and can be readily exchanged as required by production demands, without significant system downtime.

A particular advantage of the modular system is that a casting module may be removed and replaced in a relatively short period of time since only a few connections need to be made. Furthermore, periodic maintenance and repair of the modules may be performed off-line with a minimum of production line down-time.

Advantageously, in accordance with another aspect of the invention, a casting module of the system may be replaced by another module which has not only been set up and tested off-line, but also warmed up off-line to bring the unit up to the desired 10 operating temperature. In a system in accordance with this invention, the replacement of a casting module requires the casting operation be interrupted only for a period of time sufficient to disconnect a number of quick-disconnect connections, remove the casting module by means of a forklift or the like, replace the removed module with a preheated casting module and make the necessary quick-disconnect connections. Advantageously, since the new unit has been warmed up off-line and since the other units are not taken out of operation for an extended period of time, no significant system warm-up time is required and system downtime is reduced substantially.

In accordance with another aspect of the invention, a casting unit is provided with a mechanism for mechanically removing a filter that is used in the casting process. In accordance with one specific aspect of the invention, the casting unit includes a pneumatic or hydraulic cylinder mounted on a pivoting bracket having spaced apart arms attachable by means of chain or the like to a filter to be removed. Advantageously, the filter may be raised during the pouring operation such that it is completely removed from the casting before the casting solidifies, thereby avoiding certain problems of the prior art associated with the removal of filters from a casting.

In accordance with another aspect of the invention, a cope of a casting system provided with a tilting launder tray, preferably mounted on the upper platen, that is readily moved aside during the pouring operation and quickly put in the appropriate position to direct a laundering liquid into a filler neck of the upper platen.

In accordance with another aspect of the invention, the upper platen of a casting system is provided with a swinging cope which is movable between the horizontal position, in which the cope is disposed adjacent a lower surface of the upper platen, and a vertical position in which the cope is extended at a 90 degree angle to the upper platen. Advantageously, the movable platen greatly facilitates cleaning of the cope prior to a next pouring operation. In one specific embodiment of the invention, the cope is movable between the horizontal and vertical positions by one or more hydraulic or pneumatic cylinders and a hydraulic or pneumatically operated locking mechanism is provided to lock the cope in place adjacent to the upper platen.

In accordance with yet another aspect of the invention, the lower platen is advantageously provided with a pneumatic or hydraulic cylinder arrangement which serves to raise the lower platen for easier removal of a casting and is further provided with a mechanism for lifting a casting from the drag.

DETAILED DESCRIPTION

Figure 1:
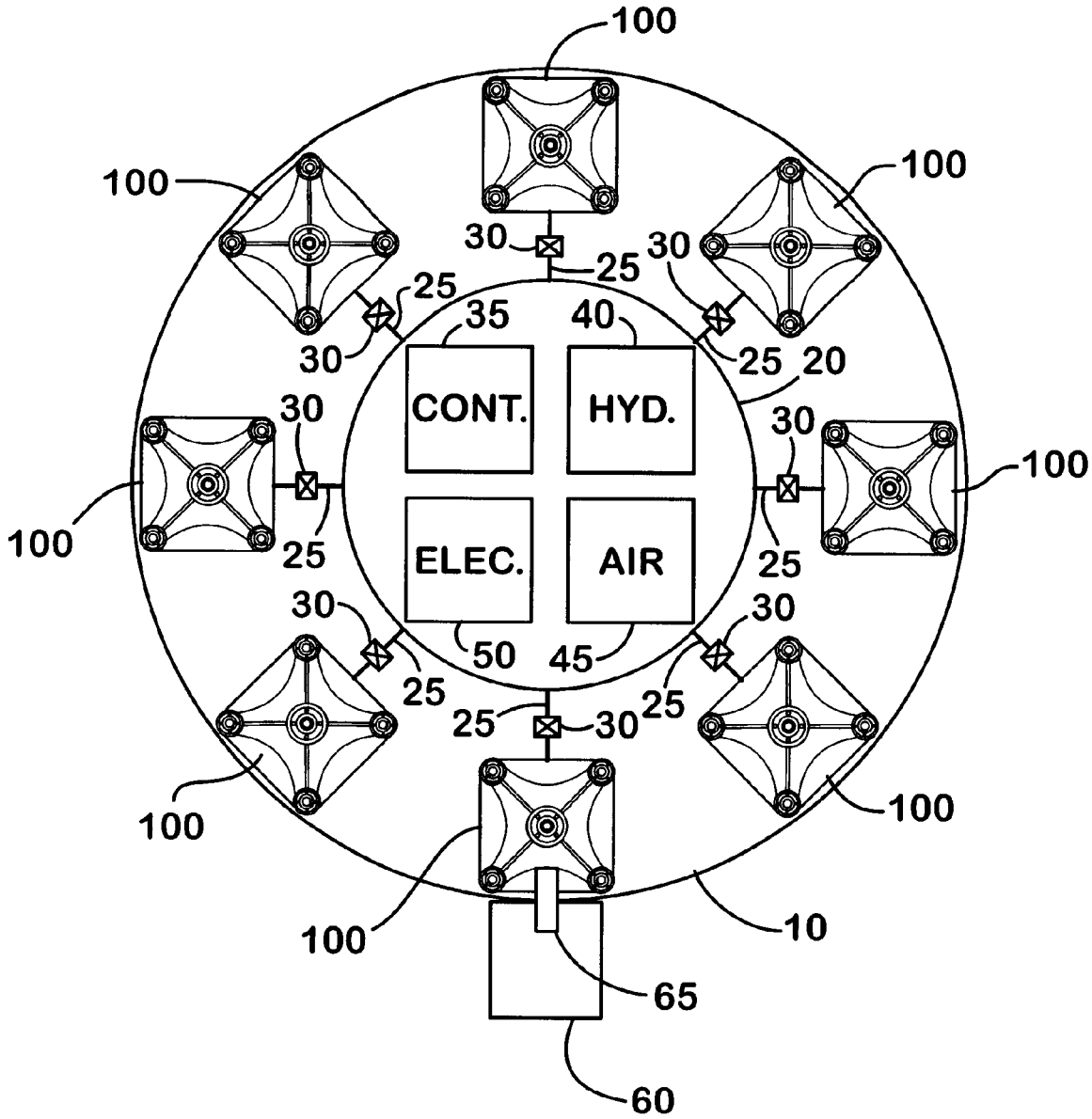
FIG. 1 is a plan view of a casting table supporting a plurality of casting modules.

FIG. 1 is a plan view schematic representation of a rotatable casting table 10 provided with a plurality of casting modules 100 and a central hub area 20 incorporating control and supply systems. The control and supply systems are connected to each of the modules 100 by means of control and supply lines 25. Each of the casting modules 100 is preferably connected to an associated control supply line 25 by means of a quick-disconnect connector 30. The central hub area 20 preferably includes an electronic controller 35, a hydraulic unit 40 providing hydraulic fluid under pressure, an air supply unit 45 providing air under pressure and an electrical supply box 50. The controller 35 may, for example, be a programmed logic array designed to provide electrical signals to various ones of the casting modules 100 to operate various air and/or hydraulic valves and/or relays. The programmed logic array may also receive signals from the various units 100 indicative of certain operations, such as actuation of limit switches, etc. The electrical supply box 50 provides electrical power to the various units 100, when required. A filling station 60 provides a source of molten material to be used in the casting modules 100. The casting table 10 may be rotated to place a casting module 100 adjacent the filling station 60. Molten material may be transferred from the filling station 60 to a casting module disposed adjacent the filling station through a transfer conduit 65 or ladle or the like.

Figure 2:
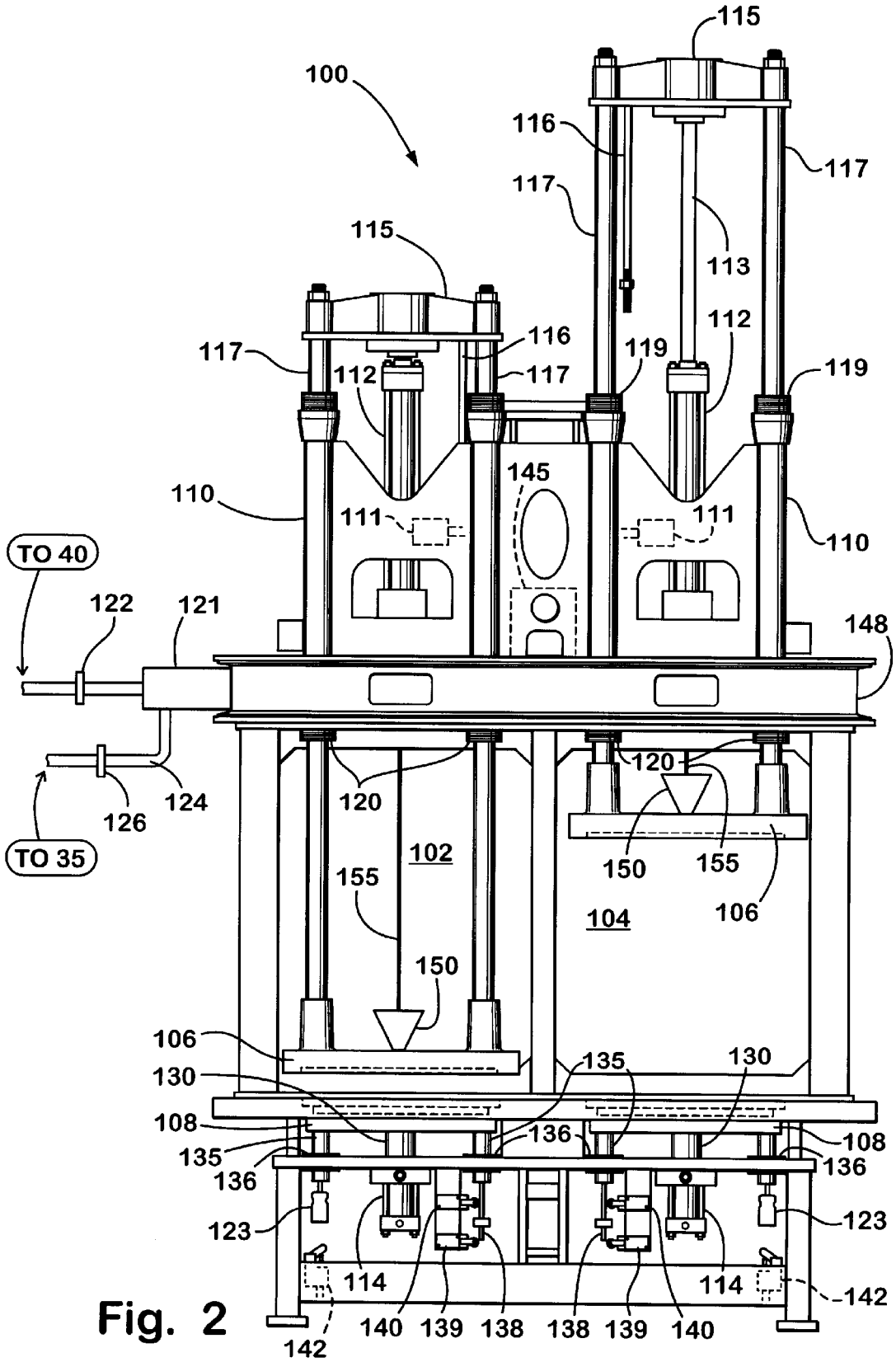
FIG. 2 is a front elevational view of a casting module in accordance with the invention.
Figure 3A:
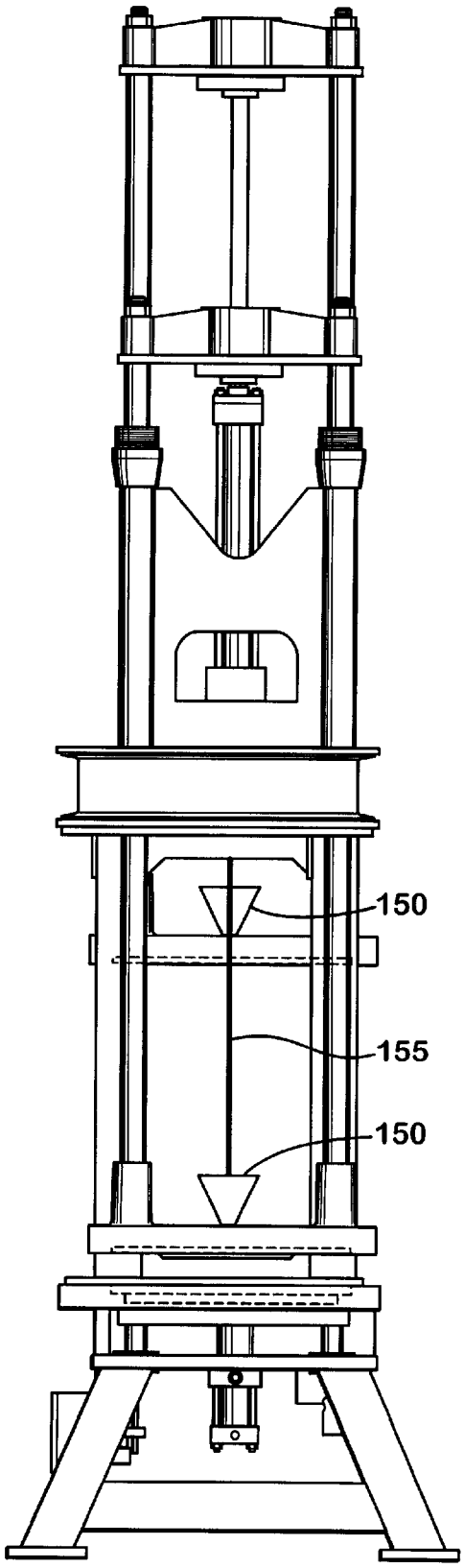
FIGS. 3A and 3B are left and right elevational views, respectively, of the module FIG. 2.
Figure 3B:
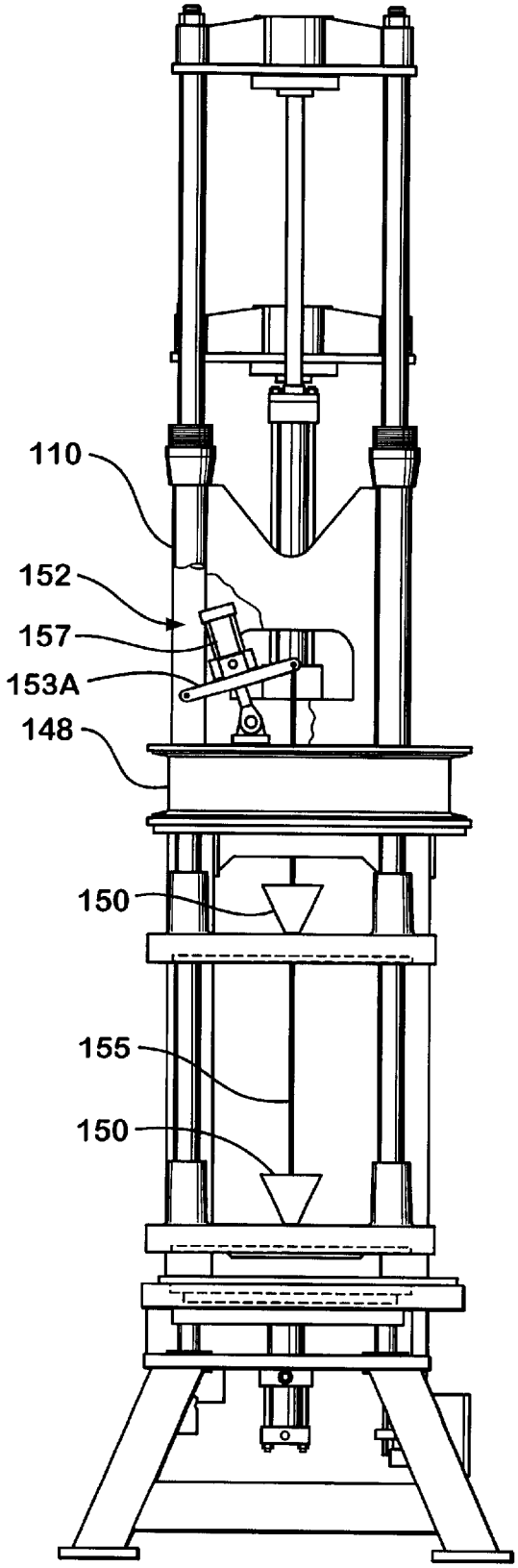

FIG. 2 is a frontal view of a dual casting module 100 consisting of two independently operable casting units 102, 104. Each casting unit is provided with an upper platen 106 for supporting a cope of a mold (not shown in the drawing) and a lower platen 108 for supporting a drag of a mold (not shown in the drawing). For the sake of clarity, one of the casting units is shown in the open position in which the upper platen is spaced apart from the lower platen and the other of the casting units is shown in a closed position in which the upper platen is disposed adjacent the lower platen. The two casting units 102, 104 operate in the same manner but are independently controlled by the controller 35. By constructing dual unit casting modules, rather than single unit casting module, a substantial savings in construction material and system connections will be realized while obtaining modularity of the system. It will be apparent that single unit casting modules may be constructed as well. In one particular application, the dual casting modules are used to cast different parts of a unit to be assembled. A casting unit, such as the dual casting unit 102, 104 consisting of two sets casting modules, may be readily moved by means of a forklift or other lifting equipment onto the rotating table 10, such that the advantages of modularity are not lost by the use of a dual unit. It will be understood that the invention applies to single units in the same manner as it applies to dual units described herein.

The upper platen 106, is moveable between a lowered position in which the cope of the mold (not shown in the drawing) supported on the upper platen 106 is disposed in immediately adjacent the drag of the mold (not shown in the drawing) supported on the lower platen 108, and a raised position in which the cope is spaced apart from the drag. When the cope is in the lowered position, the cope and the drag together form a mold ready to receive molten metal from a ladle or the like. The raising and lowering of the upper platen 106 is achieved by means of a hydraulic lift cylinder 112 having a movable shaft 113 connected to cross beam 115. The cross beam 115 is mounted to a pair of lift rods 117 extending from the cross beams 115 through guides 110 to the upper platen 106. Upper guide bearings 119 and lower guide bearings 120 are provided on upper and lower ends, respectively, of the guides 110. The guide bearings are preferably provided with a wiper seal or the like engaging the surface of the guide rods and a lubricating oil may be provided to the bearings for purpose of cooling and lubrication. The lift cylinders 112 are actuated via a control valve 121 which selectively applies hydraulic fluid under pressure from hydraulic unit 40 to the upper and lower ends of lift cylinders 112 via hydraulic quick disconnect 122 and control valve 121, thereby controlling the movement of the upper platen 106. The control valve 121 is actuated in response to signals from controller 35 applied via electrical quick disconnect 126 and electrical conductors 124. Further shown in FIG. 2, associated with the raising and lowering mechanism of the upper platen 106, is an upper platen trip rod 116. The trip rod 116 is designed to activate a switch 111 when the upper platen is lowered to its desired position. The two switches 111 are connected to the electrical disconnect plug 126 to transmit appropriate signals to the controller 35 when the switches are actuated. For the sake of clarity, the various electrical and hydraulic connections are not shown in the drawings.

The lower platen 108 is supported on a lower platen lift cylinder 114 and lift cylinder shaft 130. The lift cylinder 114 is operated to raise the lower platen to facilitate removal of a casting after the casting operation has been completed and the upper platen has been raised. The lift cylinder 114 is connected by means of hydraulic lines (not shown in the drawing) to the control valve 121 which, as mentioned earlier, is operated by electrical control signals from the controller 35 via the quick disconnect 126 and appropriate ones of the conductors 124. The lower platen 108 is supported on guide rods 135 extending through bearings 136. Connected to one of the guide rods 135 is a trip rod 138 which serves to actuate limit switches 139, 140 to indicate the position of the lower platen. The limit switches are electrically connected by selected ones of the conductors 124 to quick disconnect 126 to provide an indication to the controller 35 of the position of the lower platen.

Further shown in FIG. 2 is a pair of oil pumps 142 and an oil supply reservoir 145. The pumps and the reservoir, together with oil supply and return lines (not shown in the drawings) interconnecting the reservoir 145, the pumps 142 and the bearings 119,120 and 136 are part of a closed bearing lubrication and cooling system in which oil is drawn from the reservoir 145 and supplied to the bearings by the pumps 142 under pressure and is returned to the reservoir. When the lower platen 108 is lowered to the normal position for casting, a lube cam 122 actuates the oil pump 142 which distributes the oil under pressure to the bearings 119, 120 and 136 via oil supply lines and a series of standard distribution blocks (not shown in the drawings). The oil is returned from the bearings to the reservoir via the oil return lines to be reused.

Referring now to FIGS. 2 through 5, there is shown in FIG. 2 a filter element 150 in each of the casting units 102, 104. When a mold disposed between the upper and lower platens is in the closed position, a molten substance, such as a molten metal, is poured into the mold from a ladle or the like through an opening in the upper platen 106. A filter element 150 is provided in alignment with such opening for filtering the molten metal. Such filter elements and the use thereof in the casting process are well known in the art. In the partially cut-away right side elevational view of FIG. 3B there is shown a filter removal unit 152, for lifting the filter element 150 during a pouring. The filter element 150 is initially disposed adjacent the upper platen and is gradually lifted by the filter removal unit 152 during the pouring operation. Lifting the filters during the pouring operation facilitates removal of the filters before the casting begins to solidify and avoids a significant problem encountered in prior art systems wherein the filter is removed after the pouring operations have been completed.

Figure 4A:
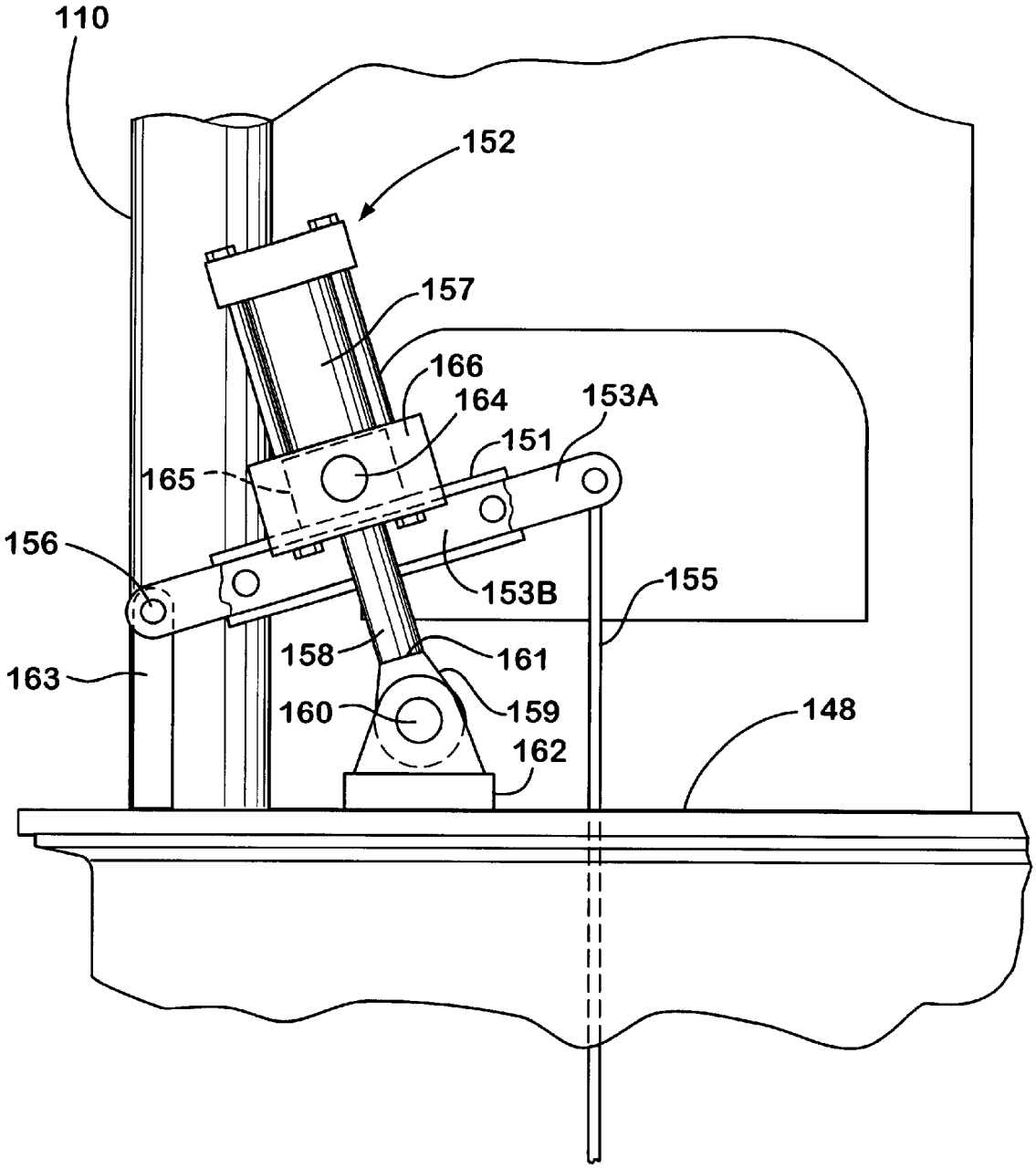
FIGS. 4A and 4B depict enlarged breakaway views of a filter lift mechanism in accordance with the invention.
Figure 4B:
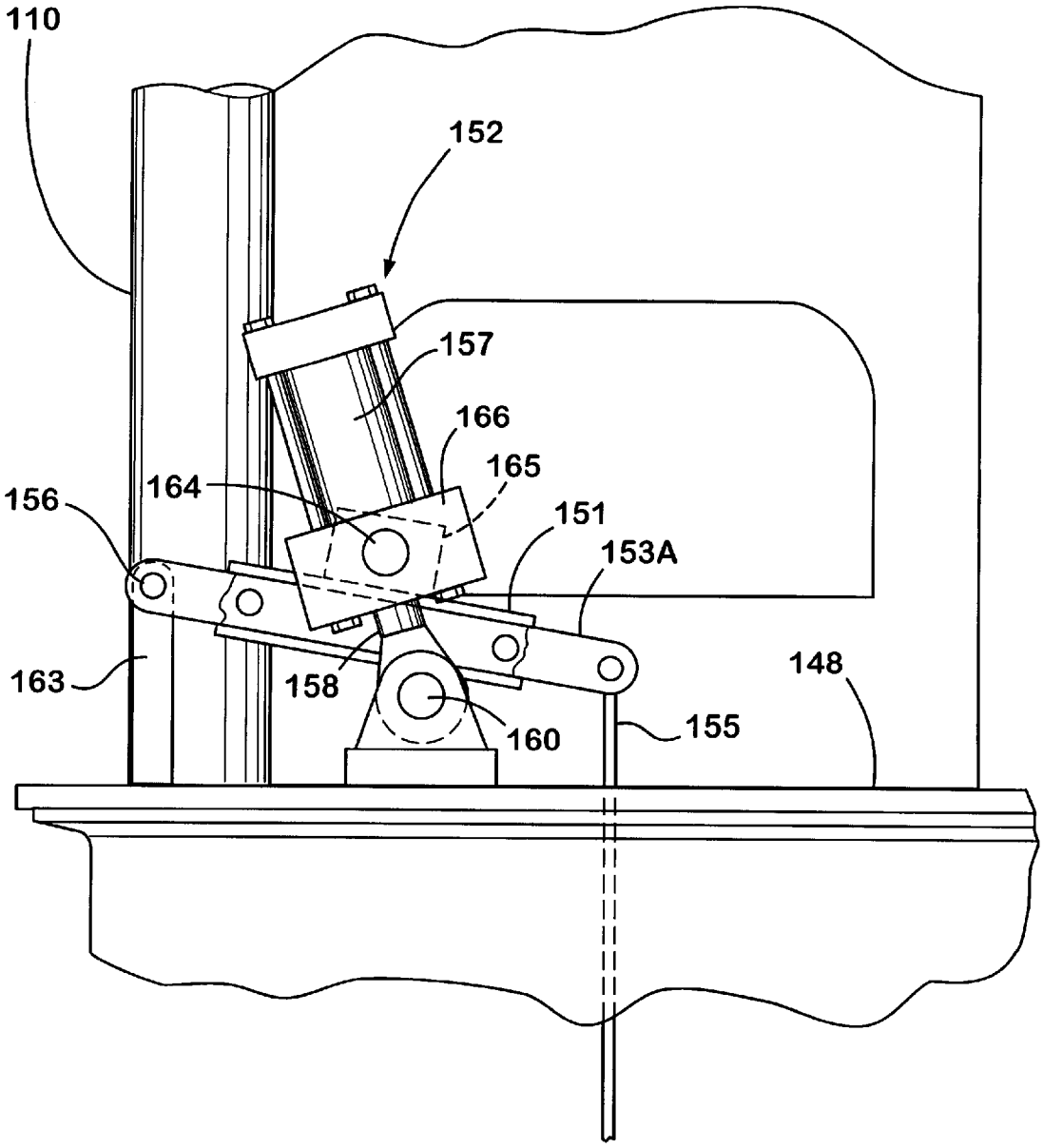
Figure 5:
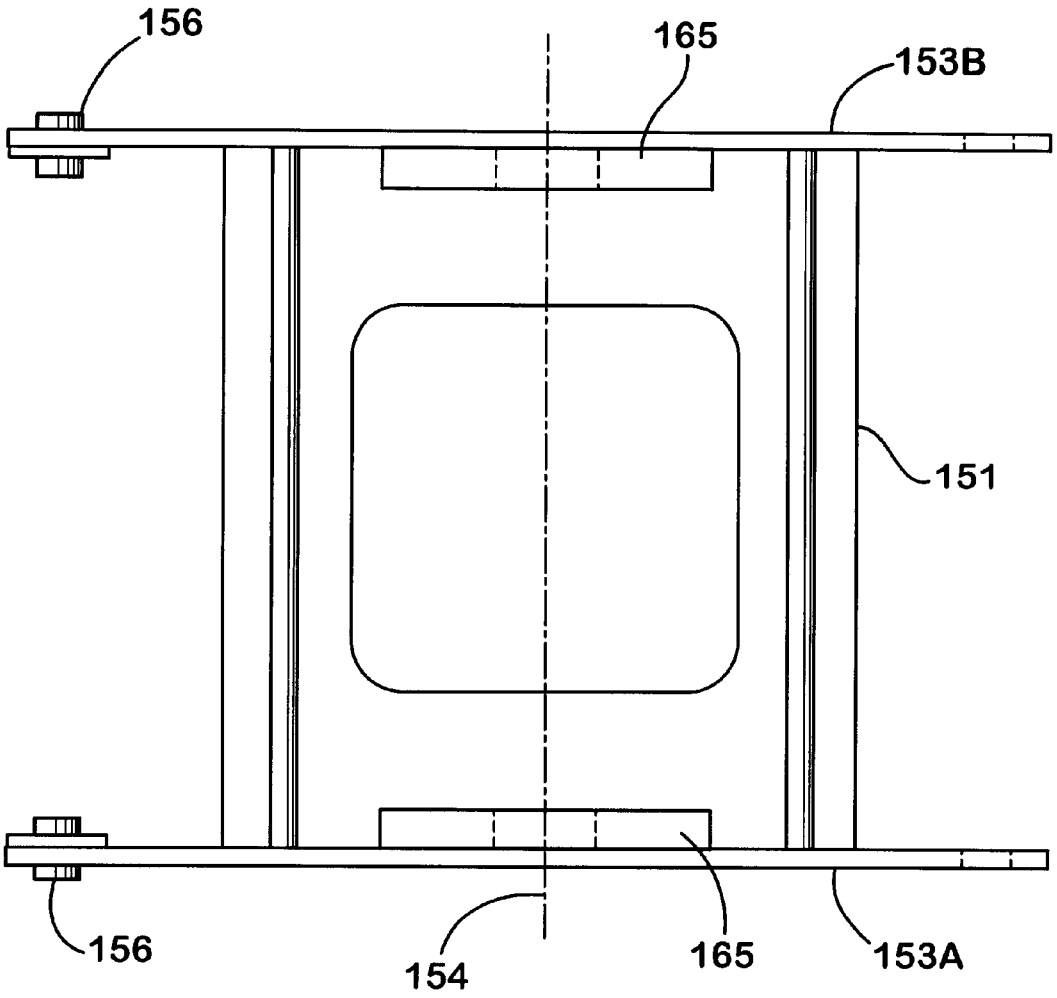
FIG. 5 is a plan view of a bracket for mounting a filter lift cylinder in the mechanism of FIGS. 4A and 4B.

As shown in detail in FIGS. 4A, 4B and 5, the filter removal unit 152 comprises a hydraulic lift cylinder 157, mounted on cylinder support bracket 151, and a piston rod 158 having a free end mounted to the frame 148. The support bracket 151 comprises a pair of spaced apart lift arms 153A, 153B each pivotally mounted to an upstanding support bracket 163 mounted on the frame 148. A chain 155 is connected from each of the lift arms to opposite sides of the filter element 150. The cylinder 157 has fluid connections to control valve 121 and is operated in response to operation of the control valve 121 by controller 35. FIG. 4A shows the filter removal unit 152 in the fully raised position and FIG. 4B shows the filter removal unit 152 in the fully lowered position. The cylinder 157 has a piston rod 158 having an end engaging a flattened surface 161 of a spherical rod eye 159, which is pivotally mounted on pivot 160 by a bracket 166 supported in a clevis bracket 162 mounted to the frame 148. Cylinder 157 is mounted to a cylinder pivot pin 164 by means of brackets 165. The cylinder pivot pin 164 is rotationally mounted to end brackets 166, along the pivot centerline 154, to allow the cylinder support bracket 151 to pivot relative to the lift cylinder 157 between the positions shown in FIGS. 4A and 4B. As the cylinder 157 is actuated, the support bracket 161 is pivoted on pivot point 156 and the lift arms 153A, B are moved between the raised and lowered positions as shown in FIGS. 4A and 4B, respectively.

Figure 6:
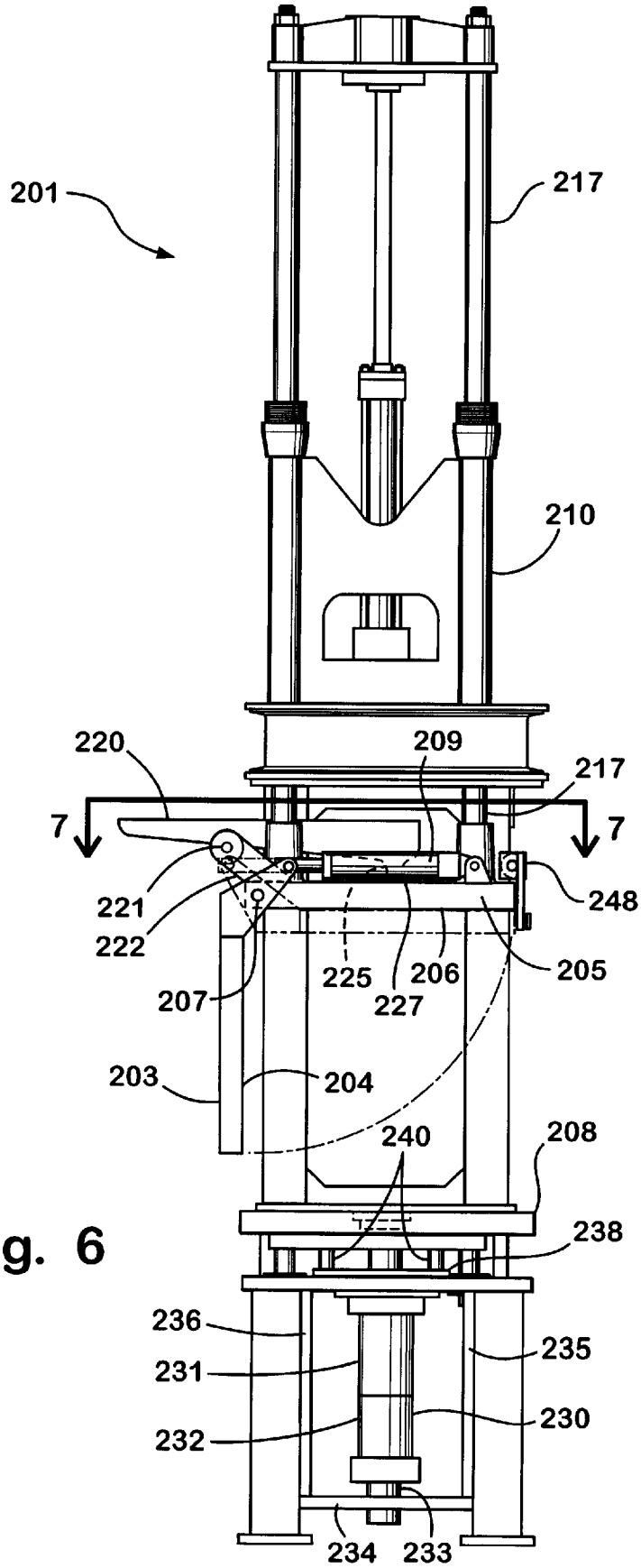
FIG. 6 is a side elevational view of a casting unit which is an alternate embodiment of the casting unit of FIGS. 2–5.
Figure 7:
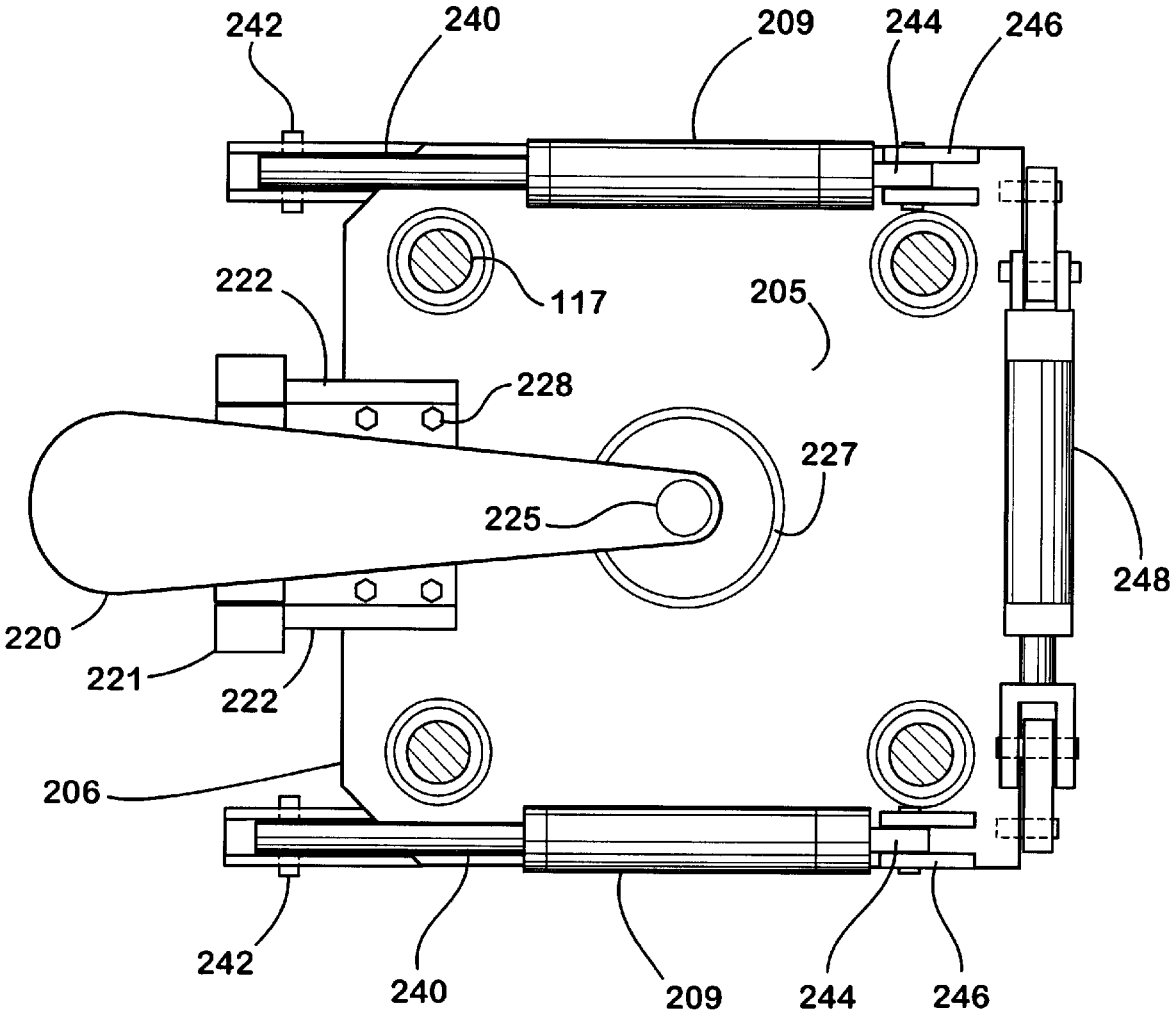
FIG. 7 is a plan view along line 7—7 of FIG. 6 showing a launder tray and a cope operating mechanism.
Figure 8:
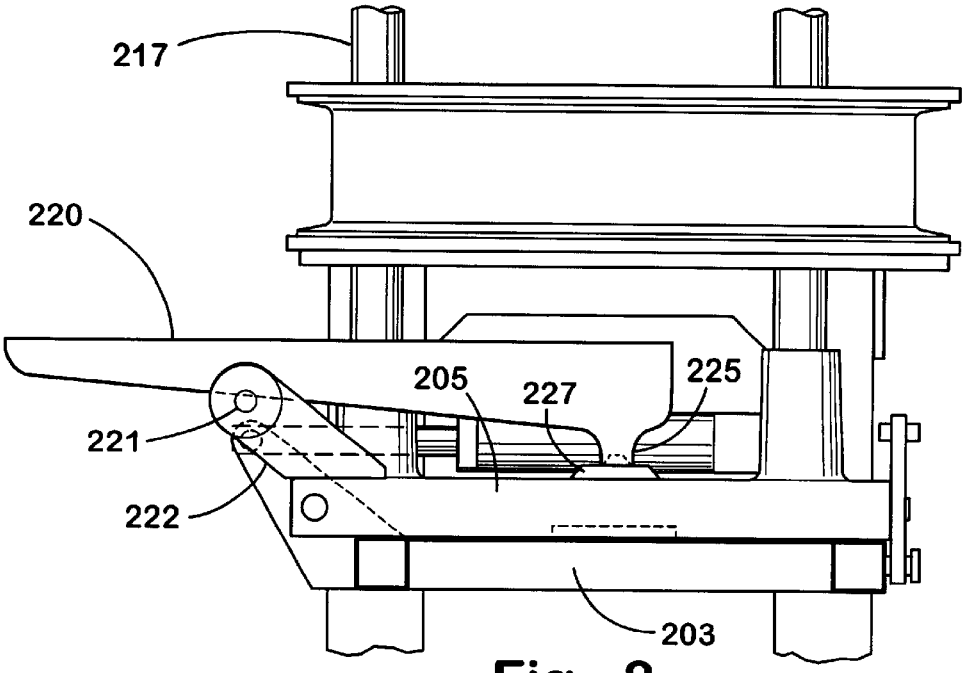
FIG. 8 is a partial breakaway side elevational view of the casting unit at FIG. 6 showing the launder tray in an operating position.
Figure 9:
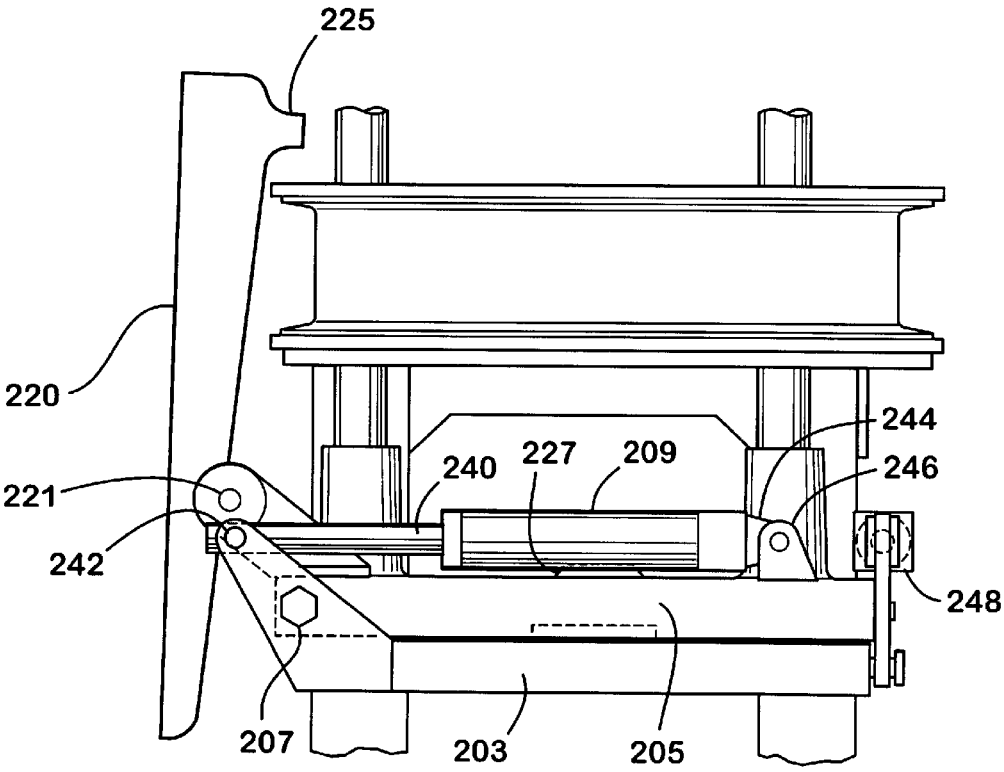
FIG. 9 is a partial breakaway side elevational view of the casting unit of FIG. 6 showing the swinging cope 203 in the closed position.

Referring now to FIGS. 6 through 12, there is shown an alternate embodiment of casting units 102, 104. The casting unit 201 is provided with a swinging cope 203 which is rotatably attached to the upper platen 205. The upper platen is supported on lift rods 217 extending through guides 210 and is shown in FIG. 6 in the raised position. The swinging cope 203 is supported on a pivot 207 on the upper platen 205. A pair of spaced apart hydraulic or pneumatic cylinders 209 is operable to move the cope from the open position shown in FIG. 6 to a closed position, as shown in FIGS. 8 and 9, in which the upper surface 204 of the cope 203 is disposed immediately adjacent the lower surface 206 of the upper platen 205. The lower surface of the cope is typically coated before each casting operation. In a production facility, such a coating may have to take place every three minutes. The swinging cope allows for quick and easy access for such coating purposes.

Figure 10:
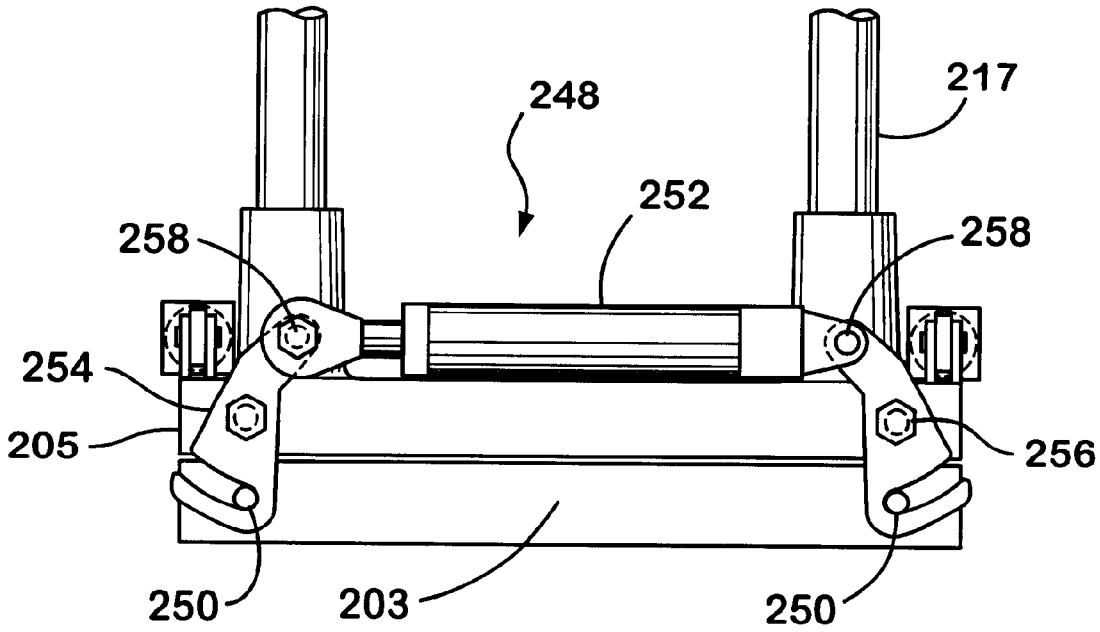
FIGS. 10 and 11 are partial cutaway right elevational views of FIG. 6 showing the cope locking mechanism in locked and unlocked states, respectively.
Figure 11:
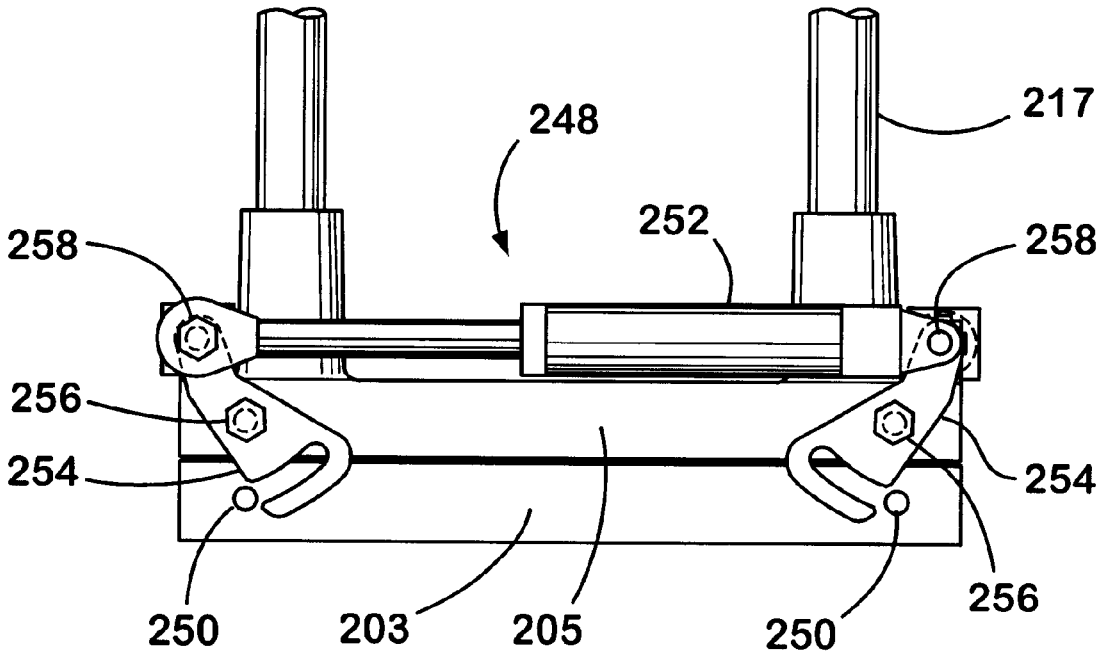

The cylinders 209 are each provided with a piston rod 240 having one end engaging the swinging cope at brackets 242. Each of the cylinders 209 has a fixed end 244 mounted to the top surface of the upper platen 205 by means of a mounting bracket 246. As readily apparent from the drawing, the cope 203 is disposed immediately adjacent the upper platen when the piston rod 240 is extended and is in the full down position when the piston rod 240 is retracted. The cope 203 is retained in a locked position with respect to the upper platen 205 by means of a locking mechanism 248. FIG. 10 shows the locking mechanism in the locked position and FIG. 11 shows it in the released position. As shown in the drawing, the cope 203 is provided with a pair of pins 250 and a pneumatic or hydraulic cylinder 252 is used to actuate a pair of latches 254, mounted on the upper platen 205. The latches are pivotally mounted on the platen 205 by means of pivot pins 256. The cylinder 252 is mounted to the two latches 254 by means of pivot pins 258. When the cylinder 252 is in the extended position, as shown in FIG. 11, the latches 254 are in the released position and the upper platen 203 may be lowered to the open position as shown in FIG. 6. After the lower platen 203 has been rotated to the position shown in FIGS. 10 and 11, the cylinder 252 is operated to the retracted position which causes the latches 254 to be rotated about the pivot pins 258 thereby engaging the pins 250 and drawing the cope 203 against the upper platen 206.

Figure 12:
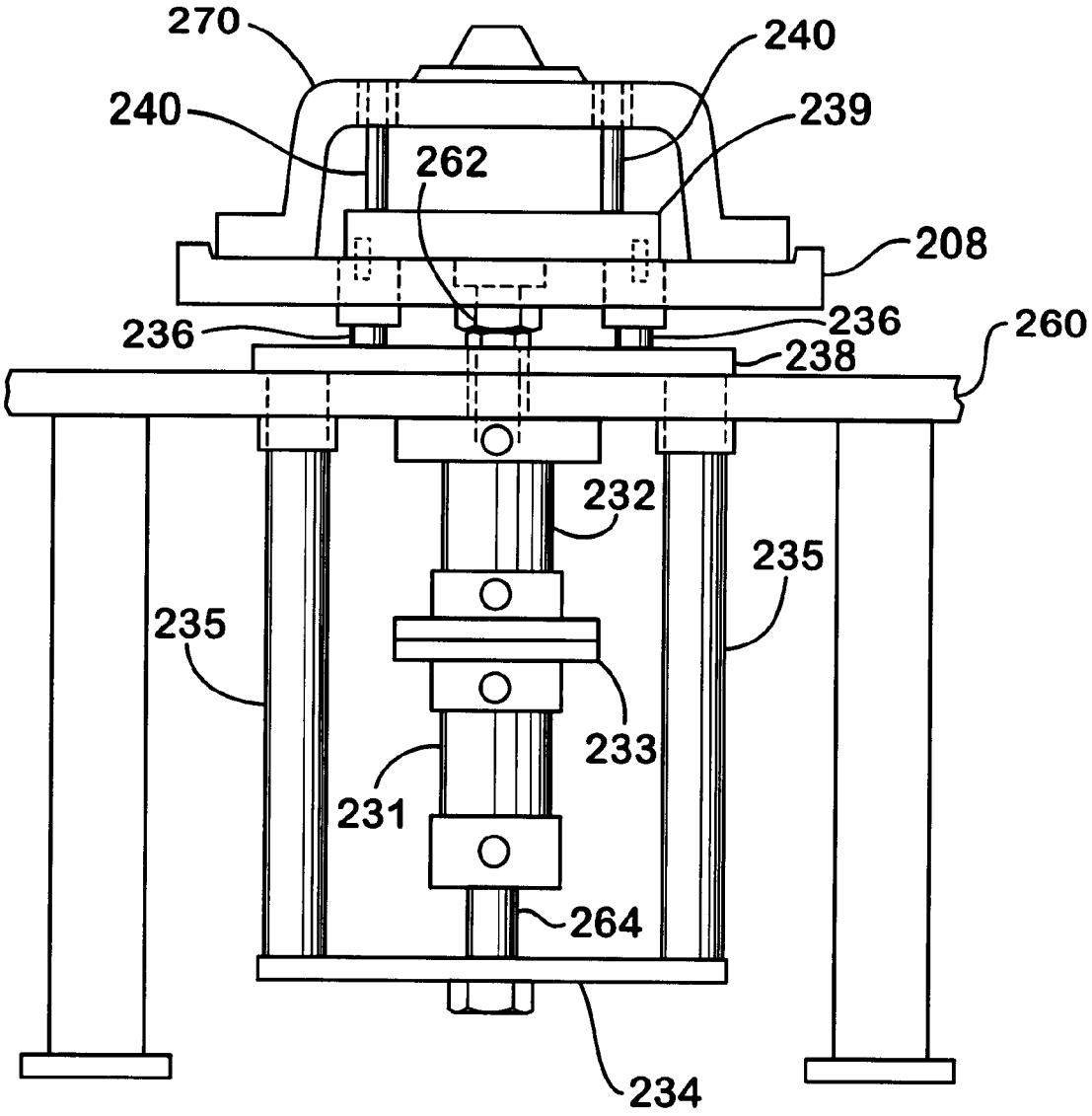
FIG. 12 is a partial cutaway enlarged frontal elevational view of the dual action lower cylinder of FIG. 6.

Further shown in FIGS. 6 through 9 is a launder tray 220. The launder tray 220 is pivotally mounted on axis 221 supported on a pair of spaced apart brackets 222 mounted to the upper platen 205 by fasteners 228. The launder tray has a filler neck 225 engaging a filler opening 227 in the upper platen 205. Further shown in FIGS. 6 and 12 is a dual action lower cylinder arrangement 230 comprises an upper cylinder 231 for raising and lowering the lower platen and a lower cylinder 232. The lower cylinder 232 engages a lower bracket 234 provided with vertically extending rods 235 and 236 engaging an upper bracket 238. The bracket 238 is provided with vertically extending pins 236 extending into a lower portion of the lower platen 208 and engaging a plate 239 supporting pins 240. When the hydraulic cylinder 232 is actuated, the brackets 234 and 238 are raised and pins 240, extending through openings in the lower platen, serve to raise the casting in the mold to facilitate removal of a casting from the mold.

Shown in FIG. 12 is an enlarged breakaway view of the lower platen lift mechanism with a casting removal assist mechanism shown is FIG.6. An upper hydraulic or pneumatic cylinder 232 is mounted to cross-member 260 and, when operated, actuates the piston 262 to raise or lower the upper platen 205, to facilitate removal of a casting from a mold 270. A lower hydraulic or pneumatic cylinder 231 is mounted to the cylinder 232 by means of flanges 233. When the lower cylinder 231 is actuated, a piston 264 raises a lower bracket 234 in the direction of the lower platen 208. A pair of vertically extending rods 235 are mounted on the lower bracket 234 and engage an upper bracket 238. Mounted on the upper bracket 238 are vertically extending rods 236 which extend through the lower platen 208 and engage a horizontally extending plate 239. Vertically extending rods 240 are mounted on plate 239 and extend through the lower portion of the mold or drag. When lower cylinder 231 is actuated, rods 240 engage and raise a casting disposed on the drag to a position where it is lifted from engagement with the drag. Advantageously, this arrangement facilitates the removal of a casting from the drag.

Further shown in FIG. 6 is a dual action lower cylinder 230 having an upper portion 231 for raising and lowering the lower platen and a lower portion 232. The lower portion 232 engages a horizontally extending bar 234 provided with vertical members 235 and 236 engaging a upper horizontal bar 238. The bar 238 is provided with vertically extending pins 239 extending into a lower portion of the lower platen 208. When the hydraulic cylinder 232 is actuated, the horizontal bars 234 and 238 are raised and the pins 240 extending through openings in the lower platen serve to eject the casting from the mold.

It is to be understood that the above-described arrangement is merely illustrative of the application of the principles of the invention and that other arrangements may be devised by those skilled in the art without departing from the spirit and scope of the invention as defined by the appendant claims.

What is claimed is:

1. A modular casting system with shared controls comprising:

a casting platform and at least one casting module removably disposed on the casting platform;

the casting platform comprising a fluid pressure source and an electrical controller for selectively generating electrical control signals;

the casting module comprising:

an upper platen for supporting a cope of a mold and a lower platen for supporting a drag of a mold;

a fluid operated lift cylinder having a cylinder rod connected to the upper platen and operative to selectively raise and lower the upper platen between an open position of the mold and a closed position of the mold; and an electrically operated fluid control valve having fluid connections connected to the fluid operated lift cylinder;

the electrically operated fluid control valve further comprising electrical connections connected to the electrical controller via a quick disconnect electrical connector and fluid connections connected to the fluid pressure source via quick disconnect fluid connectors;

the electrically operated fluid control valve responsive to said electrical control signals received from the electrical controller for selectively establishing fluid connections between fluid connections connected to the fluid pressure source and the fluid connections connected to the lift cylinder.

2. A modular casting system with shared controls comprising:

a casting platform and at least one casting module removably disposed on the casting platform, the casting platform comprising a fluid pressure source and an electrical controller for selectively generating electrical control signals;

the at least one casting module comprising an upper platen for supporting a cope of a mold and a lower platen for supporting a drag of a mold and a fluid operated lift cylinder having a cylinder rod connected to the upper platen, the fluid lift cylinder operative to selectively raise and lower the upper platen between an open position of the mold and a closed position of the mold;

the system further comprising an electrically operated fluid control valve uniquely associated with the at least one modules the fluid control valve having electrical connections connected to the electrical controller via quick disconnect connectors and fluid connections connected to the fluid pressure source via quick disconnect connectors;

the electrically operated fluid control valve responsive to said electrical control signals received from the electrical controller for selectively establishing fluid connections between fluid connections connected to the fluid pressure source and the fluid connections connected to the lift cylinder of the at least one module.

3. A modular casting system with shared controls comprising:

a casting platform and at least one casting module removably disposed on the casting platform, the casting platform comprising a fluid pressure source and an electrical controller for selectively generating electrical control signals;

the at least one casting module comprising an upper platen for supporting a cope of a mold and a lower platen for supporting a drag of a mold and a fluid operated lift cylinder having a cylinder rod connected to the upper platen, the fluid lift cylinder operative to selectively raise and lower the upper platen between an open position of the mold and a closed position of the mold;

the system further comprising an electrically operated fluid control valve uniquely associated with the at least one module, the fluid control valve having electrical connections connected to the electrical controller and fluid connections connected to the fluid pressure source via quick disconnect connectors;

the electrically operated fluid control valve responsive to electrical signals received from the electrical controller for selectively establishing fluid connections between fluid connections connected to the fluid pressure source and the fluid connections connected to the lift cylinder of the at least one module;

the system further comprising an upstanding bracket;

the upper platen being disposed within the upstanding frame and having an opening for receiving a molten substance;

the casting module further comprising a filter having opposite sides and disposed above the upper platen for filtering the molten substance; and a filter lift mechanism comprising a lift cylinder and a filter lift frame and a connecting linkage extending from the filter lift frame to the filter;

the frame having opposing side members, each of the opposing side members having one end mounted to the upstanding frame and a free end connected to one side of the filter;

the lift cylinder comprising a lift cylinder housing and a piston rod extending from the lift cylinder housing, one of the lift cylinder housing and the piston rod pivotally engaging each of the side members and another of the lift cylinder housing and the pivot rod pivotally mounted to the upstanding frame.

4. The casting system in accordance with claim 2 wherein the upper platen of each of the casting modules has a lower surface and each module has a cope supported on the lower surface of the upper platen and a filler opening extending through the platen, the casting system further comprising a movable cope of a mold hingedly mounted to the upper platen, each movable cope comprising an upper surface and a lower surface disposed opposite the upper surface of the cope and a filler opening extending through the cope from the upper surface of the cope to the lower surface of the cope;

the movable cope being movable between a closed position wherein the upper surface of the cope is disposed immediately adjacent the lower surface of the upper platen and an open position wherein the upper surface of the cope extends at approximately a right angle to the lower surface of the upper platen.

5. The casting system in accordance with claim 4 wherein the upper platen has first and second opposite sides and wherein the cope comprises a hinged end disposed adjacent the first end of the platen and a free end disposed opposite the hinged end and wherein the free end is disposed adjacent the second end of the platen when the cope is in the closed position, the cope further comprising at least one bracket disposed adjacent the hinged end, and wherein the module further comprises at least one fluid operated cylinder having one end mounted to the bracket and another end mounted to the upper platen adjacent the upper surface of the platen.

6. The casting system in accordance with claim 5 and further comprising a cope locking mechanism comprising:

at least one locking pin mounted on the cope adjacent the free end of the cope;

at least one latch pivotally mounted on the second end of the platen for engaging the locking pin when the cope is in the closed position; and a latch locking mechanism for selectively operating the latch.

7. The casting system in accordance with claim 6 wherein the latch locking mechanism comprises a fluid cylinder for operating the latch.

8. The casting system in accordance with claim 6 wherein the cope locking mechanism comprises first and second locking pins mounted on the cope adjacent the free end of the cope and first and second latches mounted on the second end of the platen and the locking mechanism comprises a fluid cylinder having first and second opposite ends mounted to the first and second latches, respectively.

9. The casting system in accordance with claim 4 wherein the upper platen of each of the casting modules has an upper surface and first and second opposite ends and each of the casting modules further comprises a launder tray pivotally mounted on the upper surface of each of the casting modules adjacent the first of the opposite ends, the launder tray having a fill end adjacent the first of the opposite ends and a filler neck disposed in alignment with the filler opening in the platen, whereby the launder tray is movable between a first position wherein the filler neck is in alignment with the filler opening for cope laundering purposes to a second position wherein the launder tray is disposed away from the filler opening, providing access to the filler opening for a casting operation.

10. The casting module in accordance with claim 9 wherein the upper platen comprises a pair of spaced apart brackets disposed adjacent the first of the opposite ends and wherein the launder tray is pivotally mounted on the brackets.

11. The casting module in accordance with claim 2 wherein the drag comprises a lower surface and each module further comprises a lower platen lift cylinder comprising an upper piston and a lower piston and at least one pin extending through the lower surface of the drag and wherein the upper piston is operative to move the lower platen between a first position for receiving a molten substance and a second position, raised with respect to the first position, to facilitate removal of a casting from the drag and the lower piston is operative to actuate the at least one pin to facilitate separating a casting from the drag.

* * * * *